US006814806B2

(12) United States Patent
Zeiffer et al.

(10) Patent No.: US 6,814,806 B2
(45) Date of Patent: Nov. 9, 2004

(54) CONTROLLED FLOW APPLICATOR

(75) Inventors: Dieter Friedrich Zeiffer, Iron Station, NC (US); Christoph Walter Aurich, Clemson, SC (US); Hermann A. Neupert, Belmont, NC (US)

(73) Assignee: Gaston Systems Inc., Stanley, NC (US)

( * ) Notice: Subject to any disclaimer, the term of this patent is extended or adjusted under 35 U.S.C. 154(b) by 99 days.

(21) Appl. No.: 10/205,117

(22) Filed: Jul. 25, 2002

(65) Prior Publication Data

US 2004/0016399 A1 Jan. 29, 2004

(51) Int. Cl.[7] ..... B05C 3/02
(52) U.S. Cl. ..... 118/411; 118/602
(58) Field of Search ..... 239/76, 553, 553.5, 239/461, 562, 124; 427/243, 358, 356; 425/467, 466; 118/411, 602, 410, 412, 325, 315, 419

(56) References Cited

U.S. PATENT DOCUMENTS

| | | | |
|---|---|---|---|
| 2,114,618 | A | 4/1938 | Wallin |
| 2,992,627 | A | 7/1961 | Ring |
| 3,042,573 | A | 7/1962 | Roberts |
| 3,832,427 | A | 8/1974 | Mutch |
| 3,969,780 | A | 7/1976 | Henderson |
| 4,016,831 | A | 4/1977 | James et al. |
| 4,023,526 | A | 5/1977 | Ashmus et al. |
| 4,061,001 | A | 12/1977 | von der Eltz et al. |
| 4,062,989 | A | 12/1977 | Long |
| 4,064,891 | A | 12/1977 | Eberhardt |
| 4,072,775 | A | 2/1978 | James et al. |
| 4,089,296 | A | 5/1978 | Barchi |
| 4,159,355 | A | 6/1979 | Kaufman |
| 4,225,638 | A | 9/1980 | Waugh |
| 4,237,818 | A | 12/1980 | Clifford et al. |
| 4,239,821 | A | 12/1980 | McLean et al. |
| 4,292,918 | A | 10/1981 | Davis et al. |
| 4,297,860 | A | 11/1981 | Pacifici et al. |
| 4,299,591 | A | 11/1981 | Gregorian et al. |
| 4,305,169 | A | 12/1981 | Vidalis |
| 4,326,904 | A | 4/1982 | Eckert et al. |
| 4,343,835 | A | 8/1982 | Jones et al. |
| 4,349,930 | A | 9/1982 | Van Wersch et al. |
| 4,357,373 | A | 11/1982 | Cooper |
| 4,364,784 | A | 12/1982 | Van Wersch et al. |
| 4,384,867 | A | 5/1983 | Grüber |
| 4,387,118 | A | 6/1983 | Shelton |
| 4,394,289 | A | 7/1983 | Brown et al. |
| 4,398,665 | A | 8/1983 | Bryant et al. |
| 4,402,200 | A | 9/1983 | Clifford et al. |
| 4,407,767 | A | 10/1983 | Seaborn |
| 4,408,995 | A | 10/1983 | Guth et al. |
| 4,420,510 | A | 12/1983 | Kunkel et al. |
| 4,431,429 | A | 2/1984 | Booth |
| 4,442,144 | A | 4/1984 | Pipkin |
| 4,444,104 | A | 4/1984 | Mitter |
| 4,463,467 | A | 8/1984 | Grüber et al. |
| 4,463,583 | A | 8/1984 | Krüger et al. |
| 4,473,521 | A | 9/1984 | Tassone |

(List continued on next page.)

*Primary Examiner*—Brenda A. Lamb
(74) *Attorney, Agent, or Firm*—Kennedy Covington Lobdell & Hickman, LLP

(57) ABSTRACT

An applicator apparatus for controlling the uniform (or predetermined non-uniform) application of a treating fluid to a traveling fabric, web or other substrate includes one or more fluid applicators, each having spaced apart housing or body walls interconnected by a body edge preferably of a generally parabolic shape. Each applicator includes a fluid inlet in one body wall and a transversely elongated fluid outlet in the opposite body wall. The body walls define a fluid distribution chamber extending substantially equally and oppositely relative to the fluid inlet, with the chamber being divided by a plate member having preferably generally parabolically shaped peripheral edges substantially corresponding in shape with and spaced inwardly from the body edge.

50 Claims, 6 Drawing Sheets

U.S. PATENT DOCUMENTS 4,485,508 A 12/1984 Otting
4,490,428 A 12/1984 Long
4,500,039 A 2/1985 Pacifici et al.
4,501,771 A 2/1985 Long
4,502,304 A 3/1985 Hopkins
4,512,279 A 4/1985 Damrau et al.
4,521,362 A 6/1985 Tassone
4,528,214 A 7/1985 Long et al.
4,548,611 A 10/1985 Paterson et al.
4,548,837 A 10/1985 Yoshino et al.
4,557,218 A 12/1985 Sievers
4,562,097 A 12/1985 Walter et al.
4,565,715 A 1/1986 Long
4,569,107 A 2/1986 Pomeroy
4,576,112 A 3/1986 Funger et al.
4,581,254 A 4/1986 Cunningham et al.
4,582,660 A 4/1986 Tassone
4,622,243 A 11/1986 Long
4,624,213 A 11/1986 Long et al.
4,624,813 A 11/1986 Long
4,637,940 A 1/1987 Long
4,641,404 A 2/1987 Seydel et al.
4,644,900 A 2/1987 Poterala
4,655,056 A 4/1987 Zeiffer
4,656,063 A 4/1987 Long et al.
4,661,399 A 4/1987 Anderson, Jr. et al.
4,711,792 A 12/1987 Long
4,741,924 A 5/1988 Long et al.
4,753,823 A 6/1988 Long
4,769,260 A 9/1988 Long
4,773,110 A 9/1988 Hopkins
4,792,252 A 12/1988 Kremer et al.
4,796,558 A 1/1989 Chartrand et al.
4,844,001 A 7/1989 Jones
4,943,451 A 7/1990 Zimmer
4,944,078 A 7/1990 Nakade
4,970,039 A 11/1990 Long
5,008,131 A 4/1991 Bakhshi
5,009,932 A 4/1991 Klett et al.
5,066,428 A 11/1991 Manlowe et al.
5,074,883 A 12/1991 Wang
5,089,296 A 2/1992 Bafford et al.
5,145,527 A 9/1992 Clifford et al.
5,165,261 A 11/1992 Cho
5,202,077 A 4/1993 Marco et al.
5,219,620 A 6/1993 Potter et al.
5,277,041 A 1/1994 Ahrweiler et al.
5,340,609 A 8/1994 Arthur et al.
5,403,622 A 4/1995 Nishi et al.
5,409,733 A 4/1995 Boger et al.
5,418,009 A 5/1995 Raterman et al.
5,429,840 A 7/1995 Raterman et al.
5,484,453 A 1/1996 Baehr et al.
5,505,995 A 4/1996 Leonard
5,516,273 A * 5/1996 Delmore et al.
5,524,828 A 6/1996 Raterman et al.
5,525,373 A 6/1996 Chandler
5,556,471 A 9/1996 Boccagno et al.
5,642,548 A 7/1997 Osbourn
5,654,031 A * 8/1997 Delmore et al.
5,657,520 A 8/1997 Greenway et al.
5,887,519 A 3/1999 Zelko
5,891,812 A 4/1999 Honeycutt et al.
6,395,088 B1 5/2002 Zeiffer

* cited by examiner

CONTROLLED FLOW APPLICATOR

BACKGROUND AND SUMMARY OF THE INVENTION

The present invention relates generally to an applicator apparatus for applying a flowable liquid treatment fluid, in either foamed or a non-foamed state, including dyes, sizings, stains or other treating fluids, across the width of a traveling substrate, including, but not limited to, webs or sheets of textile or non-textile materials, woven or non-woven or multi-stranded materials, flexible or non-flexible sheets or sheet-like materials, for example. Other examples of substrates that can be treated with a controlled flow applicator according to the present invention include knitted substrates, cross-linked cellulose, loose fiber or impregnated substrates, thin tissue substrates, carpet or other floor coverings, continuous filament substrates, or any of a wide variety of other sheet-like materials known to those skilled in the art.

The finishing of textile fabrics or other sheet-like substrates typically includes applying dyes, sizings, stains or other "treating fluids" to the fabric or other substrate. Various methods and apparatuses have been used for this purpose, including passing the substrate through an immersion bath of the treating fluid, by which the fabric or other sheet took on a significant amount of the treating fluid. In these instances, the excess fluid absorbed or adsorbed by the fabric or sheet had to be removed and properly disposed of, requiring costly, time-consuming or energy-wasting equipment and processes, such as drying or curing of the substrate, for example.

Also, the disposal of waste water is a major concern of textile mills, particularly where the waste water contains dye liquor or other environmentally harmful treating chemicals.

Further, there is a continuing emphasis being placed in textile and other manufacturing processes upon cost-effectiveness of equipment, speed of application, energy efficiency, and increased uniformity of distribution of the treating fluid. As a result, other methods of applying treating fluids to substrates have been proposed in order to eliminate or at least minimize the disadvantages associated with drying of immersion treated substrates. One common alternative technique involves the application of the treating dye, sizing or other fluid treating material in a foamed condition to significantly reduce the amount of wet pick-up by the fabric or other substrate being treated, resulting in a minimal amount of required substrate, if any, as well as reduced waste and disposal concerns.

Many conventional methods and apparatuses for applying such foamed treating fluids use a multi-feed distribution chamber or manifold to spread and distribute the foamed treating fluid and to deliver it to an elongated nozzle extending transversely across the traveling substrate, which then dispenses foamed fluid onto the substrate. Examples of this are disclosed in U.S. Pat. Nos. 4,237,818 and 4,402,200, which are commonly owned with the present invention. Specifically, U.S. Pat. No. 4,237,818 discloses an upstanding distribution chamber which flares transversely from a central collection section as the chamber extends vertically to apply the foamed treating liquor to the bottom surface of a traveling substrate. In contrast, U.S. Pat. No. 4,402,200 discloses a flared distribution chamber circumferentially mounted on a cylindrical supporting member to achieve the desired transverse foam distribution while applying foamed treating fluid from above the substrate.

In each of these prior applicators, the flared nature of the distribution chamber necessarily causes the foamed treating liquor, dye or other fluid to travel a greater distance from the inlet tube to the transverse ends of the nozzle than to the central area of the nozzle. Because foamed treating fluids degenerate rather rapidly from a foamed state back into a liquid state, these flared distribution chambers cause the foam emitted from the nozzles to be in varying states of foam degeneration along the transversely-extending length of the nozzle. In many applications, this can produce undesired side-to-side variations in the wet pick-up by the substrate and thus similar undesired variations in the treating effect on, and appearance of, the substrate. Such non-uniformity or relative lack of accurate distribution control is especially acute in distribution chambers having considerable height and width as may be required for substrates of substantial widths.

In one highly successful attempt to overcome the above disadvantages, an applicator for applying a foamed treating liquor across the flat width of a traveling textile fabric or other sheet-like substrate includes a partially arcuate housing having an arcuate interior partition wall intermediate a foam inlet port and a foam emission nozzle opening in the housing. This arcuate interior partition wall, along with the flat opposite wall, defines a distribution chamber providing a turning foam pathway from the inlet port about the curved edge of the partition wall to the emission opening. The curved outer edge of the interior wall is preferably parabolic in shape to result in substantially all foam flow paths from the inlet port to the emission opening to be of substantially the same total length. Accordingly, the foam residence time within the distribution chamber is substantially constant regardless of the flow path assumed. This causes the amount of foam degeneration to occur uniformly across the applicator, resulting in improved uniformity of treatment of the traveling fabric or other substrate. Such improved single parabolic applicator is described in detail in U.S. Pat. No. 4,655,056, which is also commonly owned with the present invention and the disclosure of which is incorporated by reference herein.

Although this improvement represents a significant advancement in the substrate treating technology, increased environmental concerns have frequently made it desirable to further minimize the volume of fluid used in treating processes, thus further minimizing residual and remnant waste water or other fluid volumes. In addition, economic and installation concerns have led to the desirability of reducing applicator sizes in order to allow such applicators to be used in existing treating equipment, whereas single parabolic applicators, such as these described in the above-mentioned U.S. Pat. No. 4,655,056, sometimes require extensive equipment modification or replacement in order to accommodate their larger heights and widths.

Also, many of such treating apparatuses are used for treating a variety of substrates having a variety of different widths, thus requiring the use of nozzle end seals when the traveling substrate width is less than the applicator width. This results in relatively deep "pockets" being formed at the ends of the applicator, which can contribute to the non-uniformity (or other undesired variations) of treating fluid application. In addition, some of the foam or other treating fluid is forced to creep along the flat wall of the above-described "half-parabolic" or "single-parabolic" applicator in order to help feed the outer extremities of the applicator. This can also contribute to the various drawbacks associated with non-uniformity (or lack of accurate distribution control) and degeneration of foamed treating fluids.

The present invention seeks to overcome these disadvantages and further improve on the above-described methods and apparatuses for applying a fluid from a fluid source across the lateral or transverse width of a longitudinally traveling substrate. In a preferred embodiment, the present invention includes a fluid applicator with a body having a pair of spaced apart body side walls, which are preferably but not necessarily generally parabolic in shape at their peripheral or "radial" edges. A fluid inlet is formed in, and extends "axially" through, one of the body side walls, with the fluid inlet being in fluid communication with the fluid source. Radially outer body edge walls, which are also preferably but not necessarily arcuate in shape, interconnect the spaced body side walls on both radial outer sides relative to the fluid inlet in order to define a hollow interior fluid distribution chamber. In this preferred embodiment, the fluid chamber extends in substantially equal and opposite radial, longitudinal and lateral directions with respect to the fluid inlet, generally along a plane substantially parallel to the traveling substrate, with the fluid chamber being substantially longitudinally and laterally symmetrical with respect to the fluid inlet.

In this preferred embodiment, a plate divider or baffle member is disposed in the above-mentioned parallel plane within the interior fluid chamber and has opposite baffle side walls spaced from, and preferably substantially complementary in shape with, the body side walls. Similarly, the plate or baffle member also has plate or baffle end walls spaced from, and substantially complementary in shape with, the body edge walls. One or more support members interconnect the plate or baffle member and the body in order to hold the plate or baffle member in its spaced relationship from said body side walls and said body edge walls in order to from an annular or peripheral fluid passage therebetween.

Further, in this embodiment, a laterally elongated fluid outlet is formed in, and communicates through, the opposite body side wall on the opposite side of the plate or baffle member from the fluid inlet and is substantially longitudinally and laterally symmetrically located with respect to said fluid inlet. Thus the fluid applicator first directs fluid from the fluid inlet divergingly outwardly therefrom in the radial, longitudinal and lateral outward directions through the space between the plate or baffle member and the first body side wall, then turns the fluid and directs it through the space between the body edge wall and the plate or baffle edge wall, and then finally redirects the fluid convergingly back inwardly in the radial, longitudinal and lateral outward directions to discharge the fluid through the fluid outlet for application to the longitudinally traveling substrate. Therefore, in this preferred embodiment, the serpentine paths of the fluid from the fluid inlet to the fluid outlet are thus substantially equal in length in substantially all radial, longitudinal and lateral directions.

Thus, rather than restricting itself to one relatively large-volume applicator, the present invention also contemplates the use of one or more smaller fluid applicators in any given installation, thus providing for reductions in the size (especially height and width) of each applicator and in the total combined volume of the applicator system, when compared with a relatively large single applicator having a comparable substrate width capacity. This reduces the amount of treating fluid present in the system or assembly at any given time (and thus the amount of resultant waste), as well as making the assembly of either a single or multiple applicators more readily usable with existing equipment.

Similarly, in this regard, the use of such relatively small applicators can also reduce the total combined length of the flow path of the treating fluid through the applicator system and thus the "dwell time" and resultant degree of degeneration of the treating fluid therein, when compared with a relatively large single applicator having a comparable substrate width capacity. The number of such applicators used in a given installation will, of course, depend upon factors and considerations such as the available space, the type of equipment present on site, the expected range of widths of the substrates contemplated, and the required degree of accuracy of uniformity (or accuracy in a desired variation) of fluid application across the substrate, for example.

Also, in such multi-applicator installations, varying widths of substrates can be accommodated by turning off, or disabling individual applicators at transversely or laterally outer ends. This greatly reduces the amounts of concentrated treating fluid at the resultant end "pockets", again whether or not end seals are required. Such an installation can also have purge valves or bypass valves, or both, on at least the transversely outer applicators for purging the treating fluid at relatively slow flow rates or for flushing the system with a flushing fluid.

These and other benefits are provided by the present controlled flow applicator invention, regardless of whether the treating fluid is foamed or non-foamed, and regardless of whether one or a plurality of applicators are used in a given installation. Also, each applicator of the present invention can have a preferred double-parabolic shape, as mentioned above, or any of a number of alternate shapes, where such alternate shapes can provide serpentine paths of the fluid from the fluid inlet to the fluid outlet that are substantially equal in length in substantially all directions. It should be noted, in this regard, that accurately controlled flow applicators according to the present invention can also be advantageously used where pre-determined variations in the application of a treating fluid are desired or required. Such optional controlled variation of application of the treating fluid across or along a substrate can be accomplished by modulating the flow of the treating fluid (according to a numerically controlled pattern or sequence, for example) as the substrate travels past the discharge, by providing different sizes or shapes of the chambers and/or baffle members in the applicators in a pre-selected series across the substrate, and/or by providing applicators having fluid chambers and/or baffle members that are irregular in shape or that otherwise result in a predetermined non-uniform flow across their lateral widths.

Additional objects, advantages and features of the present invention will become apparent from the following description and the appended claims, taken in conjunction with the accompanying drawings.

DESCRIPTION OF THE PREFERRED EMBODIMENTS

FIGS. 1 through 7C of the accompanying drawings depict merely exemplary embodiments of a fluid applicator assembly, having either one or a plurality of fluid applicators, for treating a traveling fabric, a traveling group of stranded materials, or other traveling sheet-like substrates with either a foamed or non-foamed treatment fluid according to the present invention. Such illustrations are shown for purposes of illustration, however. One skilled in the art will readily ascertain that other applicator and applicator embodiments according to the invention can also be employed and that the invention can be equally and advantageously used in other fluid applicator apparatuses requiring an accurately controlled uniform (or even non-uniform) application.

Figure 1:
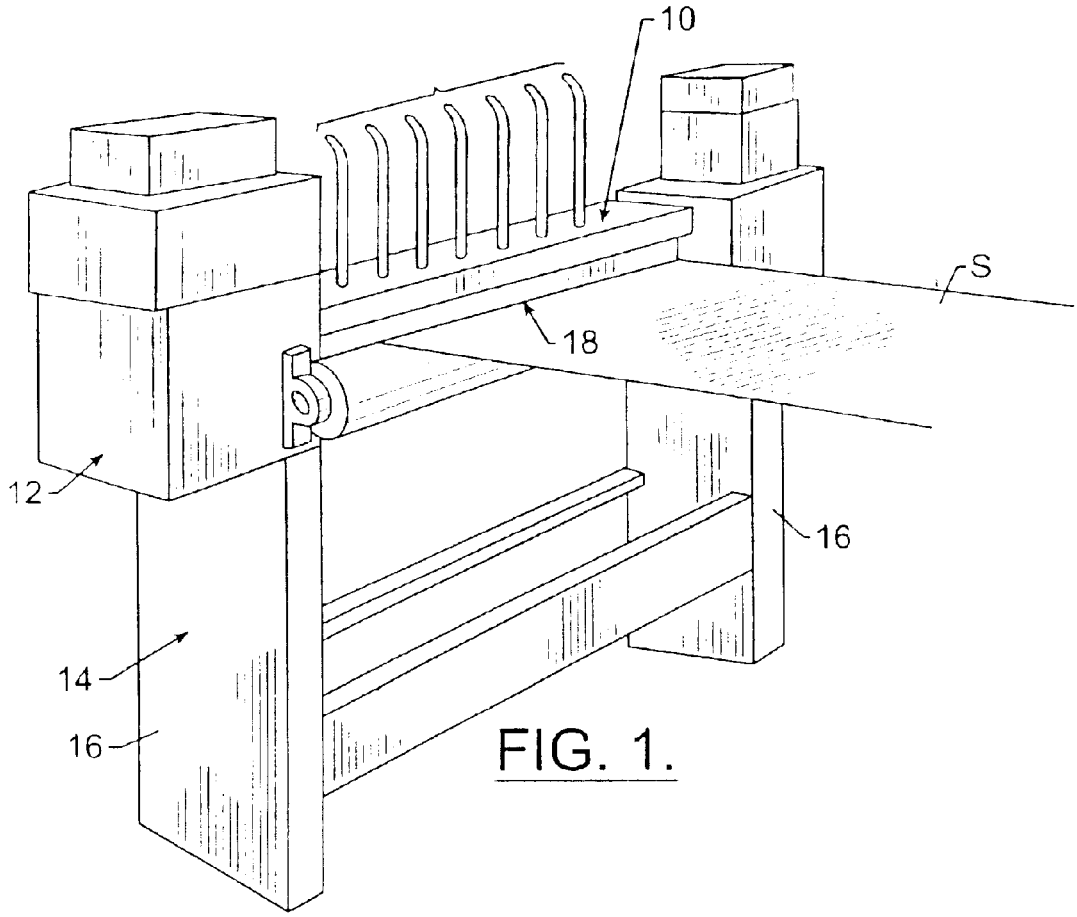
FIG. 1 is a perspective view of a preferred embodiment of a fluid distribution apparatus for applying a treating fluid according to the present invention.
Figure 2:
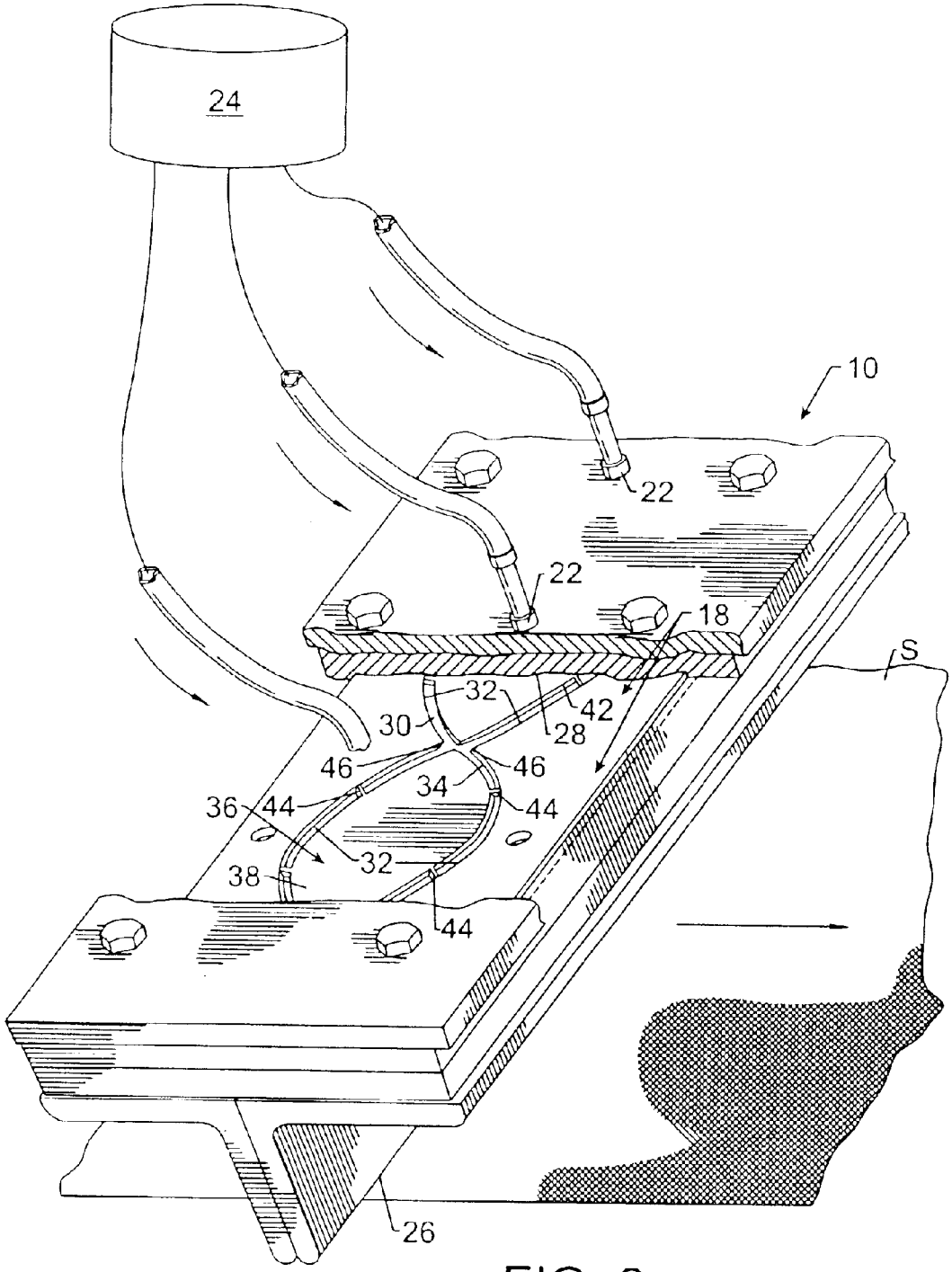
FIG. 2 is a perspective view of a multi-applicator system in the apparatus of FIG. 1, with exterior components thereof partially broken away to partially reveal interior components thereof.

Referring initially to FIG. 1, a fluid application or distribution assembly including the present invention is shown generally at 10 and is preferably incorporated into a free-standing apparatus 12 for treating a textile fabric, web or other traveling sheet-like substrate S. In this regard, as mentioned above, the present invention can be used to treat a wide variety of substrates, including substantially continuous fabrics or sheets, woven or non-woven sheets or even sheet-like arrays of strands or filaments of various materials.

The exemplary apparatus 12 shown in the drawings has a suitable floor-supported frame 14, including opposed end frame members 16 in a generally parallel and upright arrangement and spaced sufficiently apart to permit the substrate S to travel therebetween. The distribution assembly 10 can be welded or otherwise affixed to the end frame members 16 with one or more applicators 18 extending transversely or laterally across the path of the longitudinally traveling substrate S. Although the example shown in FIG. 1 includes the assembly 10 arranged for treating the substrate S from above, the applicator or applicators 18 can alternatively be arranged and positioned for applying the fluid from either side of a vertically disposed substrate or from below a horizontally disposed substrate, as is further described below and schematically illustrated in FIGS. 6A through 6C, respectively.

As shown in FIGS. 2 through 6, the assembly 10 basically includes one or more of such fluid applicators 18, each having a housing or body 20 with a fluid inlet 22 on one side for communicating treating fluid (foamed or non-foamed) thereto from a fluid source 24 (see FIG. 5, for example), which can be one or more fluid reservoirs, foam generators, or other containers or vessels containing dyes, sizings, foams or other treating fluids. A fluid outlet or nozzle 26 is provided on the opposite side of the body 20 of each applicator 18 and is positioned in close proximity with the substrate S for application of the treating fluid thereto as the substrate S travels longitudinally past the applicator 18. The fluid nozzle 26 is preferably a common elongated nozzle for all of the one or more fluid applicators 18 and extends laterally or transversely across the path of the longitudinally traveling substrate S. However, the fluid nozzle 26 can alternatively include separate and distinct nozzles for each applicator 18 if desired or deemed advantageous in a given installation, so long as adequate sealing is provided from nozzle to nozzle.

The body 20 of each applicator 18 also includes a pair of spaced apart body side walls 28 and 30 interconnected by "radially" outer body edge walls 32, which are preferably, but not necessarily, of a substantially arcuate or substantially parabolic shape. The body side walls 28 and 30 and the body edge walls 32 define a fluid distribution chamber 34 providing fluid communication between the fluid inlets 22 and the nozzle or nozzles 26. The fluid chamber 34 preferably extends in substantially equal and opposite radial, lateral and longitudinal directions, and is thus substantially symmetrical in these directions, with respect to the fluid inlet 22.

A plate or baffle member 36 is disposed within each fluid distribution chamber 34, preferably in a plane substantially parallel to the traveling substrate S. The plate or baffle member 36 includes a pair of opposite plate or baffle side walls 38 and 40, which are spaced from the respective body side walls 28 and 30 to define a fluid passageway therebetween. Similarly, the plate or baffle member 36 includes radially outer plate or baffle edge walls 42 spaced apart from the body edge walls 32 and are substantially complementary in shape therewith. In order to support and maintain the plate or baffle member 36 in such spatial disposition within the fluid distribution chamber 34, one or more support members 44 interconnect the plate or baffle member 36 with the body 20 and are preferably as small as possible in order to avoid unduly interfering with the flow of the treating fluid through the fluid passageway between the plate or baffle edge walls 42 and the body edge walls 32. It should be noted that although the exemplary plate or baffle side walls 38 and 40 and the exemplary body side walls 28 and 30 shown in the drawings are generally planar, they can alternatively be formed in other non-planar configurations so long as they are substantially complementary in shape so as to define substantially uniform respective passageways therebetween, as well as substantially uniform passageways between the plate or baffle edge wall 42 and the body edge wall 42.

It should be noted that if more than one fluid applicator 18 is used in a given installation, they are preferably arranged or disposed in an end-to-end laterally adjacent relationship with one another, with the serially arranged applicators 18 having adjacent end openings 46 sealingly aligned with each other.

It should also be noted that the body side walls 28 and 30 can be integrally recessed within their respective sides of the body 20 or alternatively formed as a result of a series of three or more plates sealingly secured to one another, with an intermediate plate having a recess or cutout formed therein or therethrough in order to define the outer periphery of the fluid distribution chamber 34. In such alternate constructions, the plate or baffle member 36 can be supported by support members 44 extending from such intermediate plate or from either of the plates adjacent thereto.

Figure 3A:
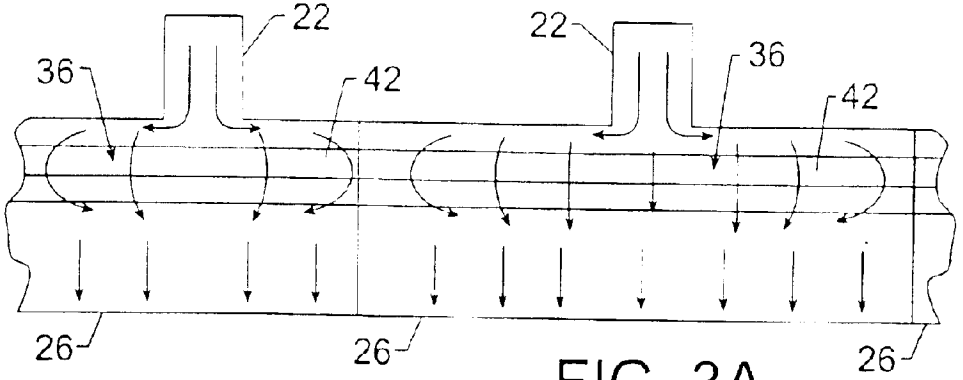
FIG. 3A is a schematic illustrative of the treating fluid flow path through optional or alternate applicators in order to create a controlled non-uniform predetermined application across the substrate if desired in a particular arrangement.
Figure 3:
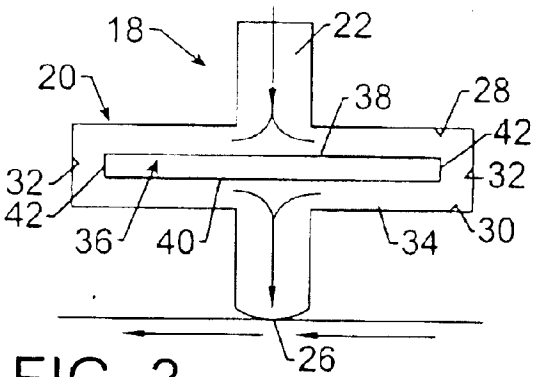
FIG. 3 is a schematic exemplary illustration of a typical path (which can discharge downwardly, upwardly or horizontally) of the treating fluid through one fluid applicator, with the treating fluid being applied from above the traveling substrate of FIG. 1.
Figure 4:
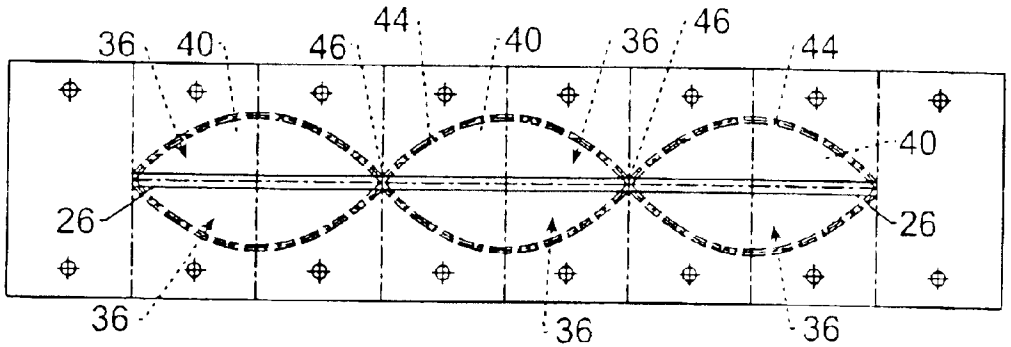
FIG. 4 is a schematic illustration of the fluid discharge or elongated nozzle side of the fluid applicator system of FIG. 2.

The shapes and configurations described above preferably result in a serpentine treating fluid flow path through the one or more fluid applicators 18, as illustrated in FIG. 3. The treating fluid is first directed divergingly outwardly from the fluid inlet 22 in equal and opposite radial, lateral and longitudinal directions between the body and plate or baffle side walls 28 and 38 (see FIG. 4), then preferably turning or reversing direction through the space between the body and plate or baffle edge walls 32 and 42, then convergingly directed back inwardly in opposite radial, lateral and longitudinal directions within the space between the body and plate or baffle side walls 30 and 40 (see FIG. 4), where it is then finally discharged from the fluid outlet or nozzle 26 and onto the traveling substrate S. Therefore, because of the preferred substantially "double parabolic" shape of the baffle member 36 and the fluid distribution chamber 34, the infinite number of flow paths of the treating fluid from the fluid inlet 22 to the elongated fluid outlet or nozzle 26 are substantially equal in length in substantially all of the radial, lateral and longitudinal directions.

It should be emphasized, however, that the present invention is not limited to the arcuate or substantially parabolic shapes discussed above. One skilled in the art will now readily recognize that such substantially equal flow paths can be accomplished using other shapes, including non-parabolic or even non-arcuate shapes. It should also be noted that the applicator 18 can also be oriented to discharge in any direction in addition to the vertical downward direction shown in FIG. 3.

As a result of such configurations, the present applicator or applicators 18 cause all of the treating fluid flowing therethrough to have a substantially constant residence time within the applicator 18. It is also important that the supply piping 23 between the fluid source 24 and each inlet 22 be equal in length in order to maintain such uniformity of fluid residence time between the fluid source 24 and the inlets 22 all the way through to the fluid nozzle 24. This is especially critical with foamed treating fluids since the natural tendency of a foamed treating liquor to degenerate back to a liquid state will occur uniformly throughout the distribution chamber in the directions of the various possible flow paths from the fluid inlet 22 to the fluid outlet or nozzle 26. Thus a foamed treating fluid emitted through any part of the elongated fluid nozzle 26 will have degenerated, if any, to substantially the same extent. The resultant uniformity of the foamed treating fluid produces a correspondingly uniform treatment of the substrate S with substantially no side-to-side variation in the wet pick-up by the substrate S of the fluid or in the treating effect of the fluid on the substrate S and its resultant appearance. Such substantial uniformity of fluid application across the full extent of the nozzle 26 is also highly advantageous in installations using either foamed or non-foamed dyes, where color uniformity across the substrate S is very important.

Figure 6:
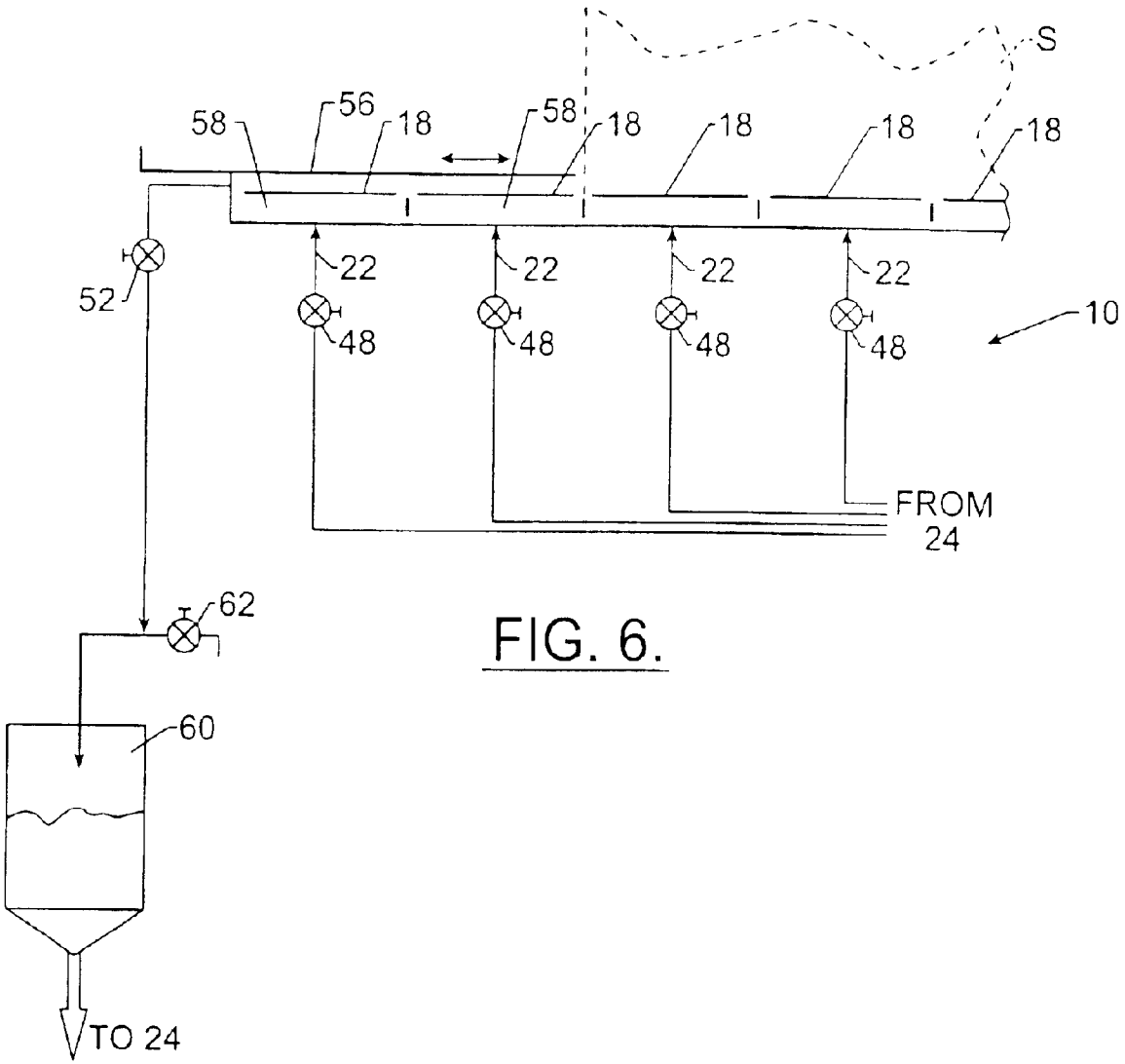
FIG. 6 is a schematic flow diagram, illustrating a fluid applicator system having an end purging feature, according to the present invention.

The turning or reversing pathway through the distribution chamber 34 provided by the present invention also produces a more vertically compact applicator unit, especially where more than one fluid applicator 18 is required for wider substrate applications in place of a much wider and thus much taller single applicator of a size that would span the entire transverse width of such a wide substrate. Furthermore, as is schematically illustrated in FIGS. 3 and 6, the invention contemplates the application of either foamed or non-foamed treating fluids from above, below, or either side of a traveling substrate S with substantially comparable results. Adjacent applicators 18 can also optionally have baffle members 36 and/or fluid distribution chambers 34 that have differing sizes or shapes, as shown in FIG. 3A, where a controlled but non-uniform application of the treating fluid is desired.

Figure 5:
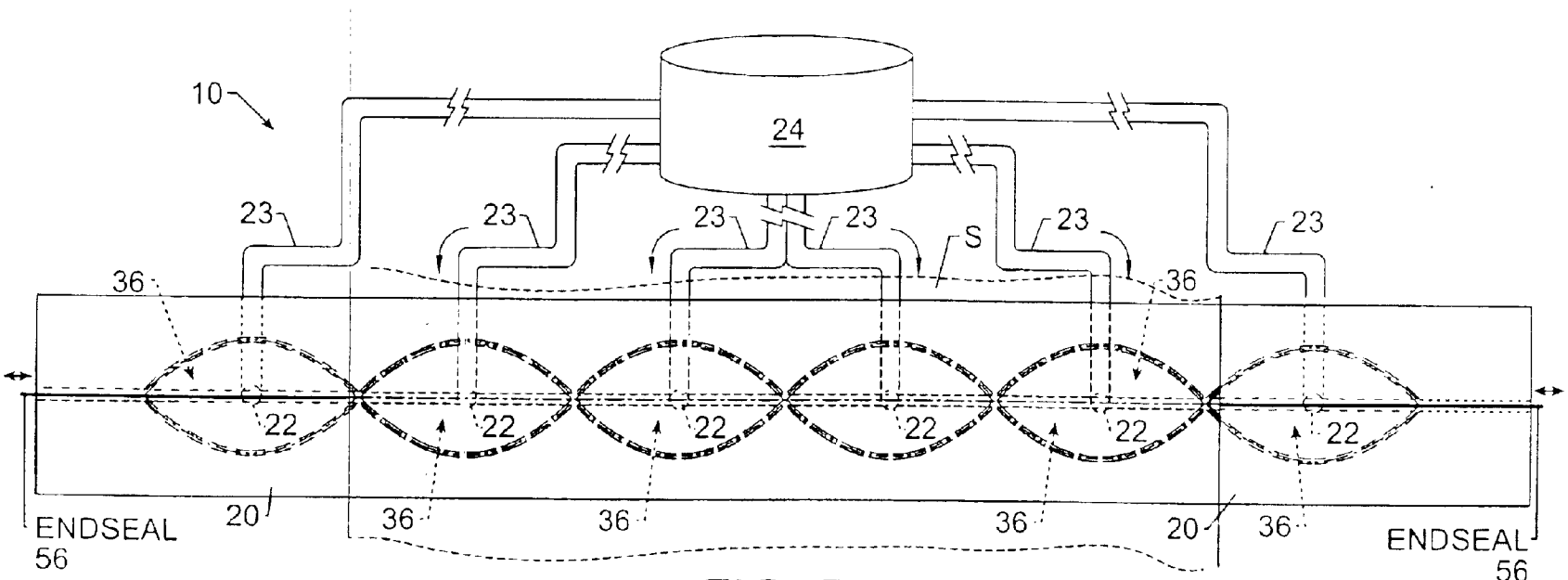
FIG. 5 is a schematic illustration of another multi-applicator system, according to the present invention, used in the application of a treating fluid to a relatively wide traveling substrate.

Referring primarily to FIG. 5, the applicator or distribution assembly 10 is adaptable for treating a wide variety of substrates S, with varying lateral or transverse widths. Although this capability exists even with assemblies having only a single fluid applicator 18, it is especially enhanced in installations having multiple fluid applicators 18. This is because the fluid inlets 22 can be selectively opened or closed (see FIG. 6) to activate only the number of fluid applicators 18 that are required for a given width of the substrate S. Furthermore, the flow of fluid supplied to the various inlets 22 can be varied laterally across the substrate S to create a predetermined controlled, but accurately repeatable, non-uniform pattern across the lateral width of the substrate S, or even modulated to create a repeatable non-uniform pattern along the longitudinal length of the substrate S.

In addition, as shown for purposes of illustration in FIG. 5, where the substrate S is narrower than the maximum width capacity of the assembly 10, flexible end seals 56 can be sealingly attached to the laterally outer ends of one or more of the laterally outer applicators 18 in order to accommodate the lesser width of a particular substrate S. The end seals 56 are laterally movable and preferably biased inwardly to follow or track the edges of the traveling substrate S. This, however, creates the end "pocket" areas 58, into which the treating fluid can flow even if the laterally outer applicators 18 are closed off by closing their associated inlet valves 48.

To address this situation and others, the present invention can alternatively provide the arrangement exemplified in FIG. 6, wherein a preferably two-position (open/closed) flushing valve 52 on at least the laterally outermost applicator 18 can be opened to allow the flushing or purging discharge of treating fluid from the assembly 10, such as during downtime, maintenance or cleaning operations. This eliminates, or at least substantially minimizes, the resultant inaccuracy of application (or controlled non-uniformity) is desired.

Furthermore, as is shown for purposes of example in FIG. 6, the present invention can include a recirculation tank, vessel or system, indicated generally by reference numeral 60, into which purged or flushed treating fluid can be discharged for subsequent re-use (including being revitalized or re-foamed, if necessary, in foamed treating fluid installations) before being reintroduced into the assembly 10. In order to replenish the system for the amount of treating fluid source 24 that has lost due to its being applied to the substrate, a make-up valve 62 can also be included.

FIG. 6 also illustrates the inlet valves 48 for opening, closing, or even modulating the treating fluid flow to the various serially adjacent applicators 18, as required in a given controlled, uniform (or even controlled non-uniform) treating application.

Figure 7A:
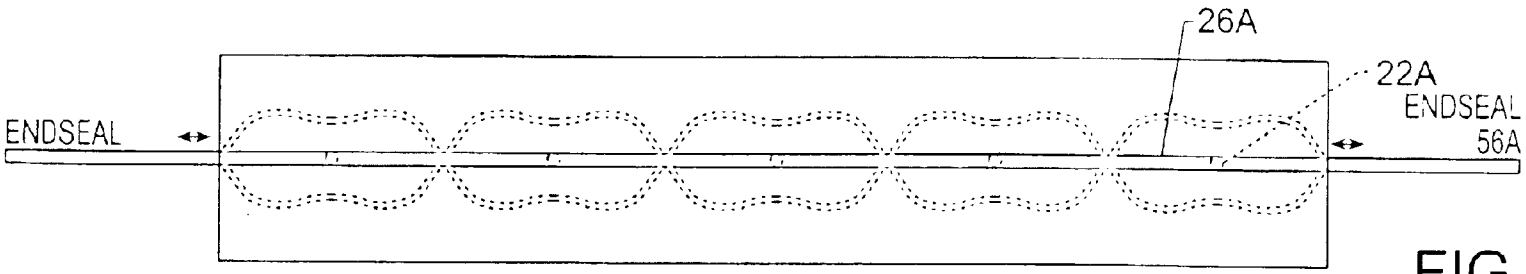
FIGS. 7A through 7C illustrate optional applicators for use in a variety of controlled but non-uniform treating applications.
Figure 7B:
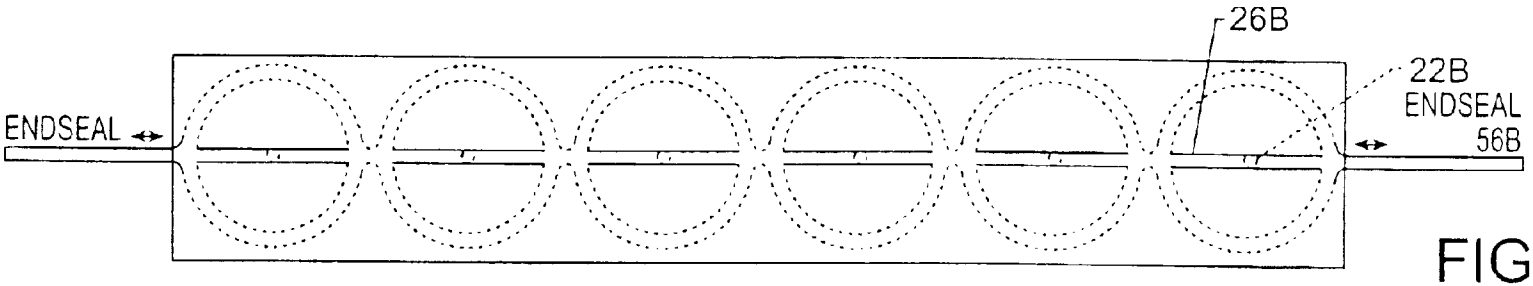
Figure 7C:
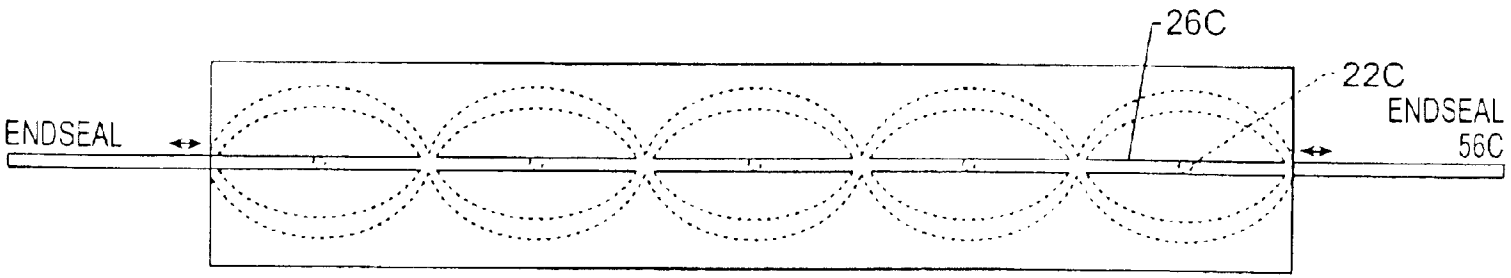

FIGS. 7A through 7C include reference numerals that correspond to those of FIGS. 1 through 6, but that have respective "A", "B", and "C" suffixes. FIGS. 7A through 7C illustrate merely representative examples of applicators having other shapes or configurations of baffle members and/or fluid distribution chambers to produce various desired, controlled uniform or controlled non-uniform treating fluid applications. Other examples will now readily occur to the skilled artisan.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention, as described in the drawings, the foregoing description thereof, and the appended claims, without departing from the substance or scope of the present invention. Accordingly, while the present invention has been described in detail in relation to its preferred embodiments, it is to be understood that this disclosure is only illustrative and exemplary of the present invention and is made merely for purposes of providing a full and enabling disclosure of the invention. The disclosure is not intended or to be construed to limit the present invention or otherwise to exclude any such other embodiments, adaptations, variations, modifications and equivalent arrangements.

What is claimed is:

1. An applicator for applying a fluid material to a traveling substrate, said applicator comprising:

an applicator body positionable adjacent and transversely of the traveling substrate;

said applicator body having an inlet port for receiving said fluid material, an applicator nozzle having a discharge slot facing the substrate and extending transversely with respect thereto, and a fluid distribution chamber communicating between said inlet port and said discharge slot; said fluid distribution chamber having: a first portion substantially centered at said inlet port for receipt of said fluid material therefrom and extending universally outwardly therefrom for passage of said fluid material therethrough;

a peripheral fluid passage communicating with said first portion and extending therearound, said peripheral fluid passage being formed of two generally symmetrically contoured halves each having spaced ends substantially aligned with said slot and extending oppositely away from said slot alignment between said spaced ends;

a second portion having a contour similar to said first portion and disposed at a spacing toward said nozzle from said first portion and communicating with said peripheral fluid passage and said slot for flow of said fluid material therethrough transversely of said slot from said peripheral fluid passage to said slot;

the contour of said peripheral fluid passage providing substantially equidistant flow of said fluid material from said inlet port through said first portion and said second portion to said slot uniformly along said slot between said ends of said peripheral fluid passage halves.

2. An applicator according to claim 1, wherein said peripheral fluid passage is arcuate in shape.

3. An applicator according to claim 2, wherein said peripheral fluid passage is substantially parabolic in shape.

4. An applicator according to claim 1, wherein said equidistant flow is substantially equidistant in substantially all directions from said inlet port to said slot.

5. An applicator according to claim 1, wherein the fluid is a foam, and said traveling substrate web is a fibrous material.

6. An applicator according to claim 1, wherein the fluid is a foam, and said traveling substrate web is a non-fibrous material.

7. An applicator according to claim 1, wherein the fluid is a foam containing a dye, and said traveling substrate web is a fibrous material.

8. An applicator according to claim 1, wherein the fluid is a foam containing a dye, and said traveling substrate web is a non-fibrous material.

9. An applicator according to claim 1, wherein the fluid is a foam containing a sizing material, and said traveling substrate web is a textile fabric.

10. An applicator according to claim 1, wherein the fluid has a viscosity greater than the viscosity of water.

11. An applicator according to claim 1, wherein said first and second portions of said fluid distribution chamber are separated by a divider member, said applicator body including at least one support member extending across said chamber distribution chamber and supporting said divider member in-between said first and second portions of said fluid distribution chamber.

12. An applicator according to claim 11, wherein said support member extends across said peripheral fluid passage to support said divider member in-between said first and second portions of said fluid distribution chamber.

13. An applicator according to claim 1, having a plurality of said applicator bodies, said inlet ports and said fluid distribution chambers being arranged in a series extending transversely of the traveling substrate, said slots extending along said plurality of said fluid distribution chambers, said fluid distribution chambers being in end-to-end fluid communication with one another, and said fluid distribution chambers extending along a plane generally parallel to the traveling substrate.

14. A fluid applicator for applying a fluid from a fluid source across the lateral width of a longitudinally traveling substrate, said fluid applicator comprising:

a body having a pair of spaced apart body walls;

a fluid inlet formed in and extending through one of said body walls, said fluid inlet being in fluid communication with the fluid source;

an outer body edge interconnecting said spaced apart body walls to define a hollow interior fluid chamber therebetween, said fluid chamber extending in substantially equal and opposite directions relative to said fluid inlet;

a plate member disposed within said interior fluid chamber and having opposite plate walls spaced from said body walls and being substantially complementary in shape therewith, said plate member having an outer plate edge substantially complementary in shape with said body edge and spaced therefrom to form a peripheral passage therebetween;

a support member interconnecting said plate member and said body and holding said plate member in said spaced relationship from said body walls and said body edge; and an elongated fluid outlet formed in and extending through the other of said body walls on an opposite side of said plate member from said fluid inlet, said fluid applicator directing fluid from said fluid inlet divergingly outwardly therefrom, through said annular passage between said body edge and said plate edge, and convergingly inwardly from said body and plate edges to discharge the fluid from said fluid outlet for application to the traveling substrate, the flow paths of the fluid from said fluid inlet to said fluid outlet being substantially equal in length in all directions.

15. A fluid applicator according to claim 14, wherein said body edge and said plate edge are arcuate in shape.

16. A fluid applicator according to claim 15, wherein said body edge and said plate edge are substantially parabolic in shape.

17. A fluid applicator according to claim 14, including a plurality of said fluid applicator bodies disposed in an end-to-end laterally adjacent relationship with one another, each of said fluid applicator bodies having an end opening formed in and extending through opposite ends of said body edge to provide fluid communication between said fluid chambers of said adjacent fluid applicator bodies for applying the fluid uniformly across a substrate having a width greater than the width of one of said fluid applicator bodies.

18. A fluid applicator according to claim 17, having at least one end seal removably and sealingly attachable to close off at least one end portion of said fluid outlet of one of said plurality of adjacent fluid applicator bodies in order to limit application of the fluid to a longitudinally traveling substrate having a width less than the total width of said plurality of said adjacent fluid applicator bodies, said end portion of said one of said fluid applicator bodies including a selectively operable flushing fluid outlet for discharging said fluid from said closed applicator bodies laterally outboard of said fluid outlet end seals.

19. A fluid applicator according to claim 18, including a selectively operable flushing valve in fluid communication with said flushing fluid outlet, and a selectively operable inlet valve in fluid communication with said fluid inlet of said one of said plurality of fluid applicator bodies, said flushing valve and said inlet valve being selectively operable for discharging a preselected quantity of the fluid that is equal to or less than a preselected quantity of the fluid flowing through said fluid inlet and into said fluid chamber of said one of said fluid applicator bodies.

20. A fluid applicator according to claim 19, further including a recirculation system selectively operable for returning said discharged fluid from said flushing fluid outlet to the fluid source.

21. A fluid applicator claim 20, wherein said recirculation system includes a recirculation tank for collecting said discharged fluid from said flushing fluid outlet, said recirculation tank being in fluid communication between said flushing valve and the fluid source.

22. A fluid applicator according to claim 14, wherein said fluid applicator has a single fluid applicator body.

23. A fluid applicator according to claim 14, wherein said fluid applicator has a plurality of said fluid applicator bodies.

24. A fluid applicator according to claim 23, wherein each of said fluid applicator bodies has a separate fluid inlet formed therein.

25. A fluid applicator according to claim 14, wherein the fluid is a foam material, and said traveling substrate is a fibrous material.

26. A fluid applicator according to claim 14, wherein the fluid is a foam material, and said traveling substrate is a non-fibrous material.

27. A fluid applicator according to claim 14, wherein the fluid is a foam containing a dye, and said traveling substrate is a fibrous material.

28. A fluid applicator according to claim 14, wherein the fluid is a foam containing a dye, and said traveling substrate is a non-fibrous material.

29. A fluid applicator according to claim 14, wherein the fluid is a foam containing a sizing material, and said traveling substrate is a fibrous material.

30. A fluid applicator according to claim 14, wherein the fluid is a foam containing a sizing material, and said traveling substrate is a non-fibrous material.

31. A fluid applicator according to claim 30, including a plurality of said fluid applicator bodies disposed in an end-to-end laterally adjacent relationship with one another, each of said fluid applicator bodies having an end opening formed in and extending through opposite ends of said body edge to provide fluid communication between said fluid chambers of said adjacent fluid applicator bodies for applying the fluid across a substrate having a width greater than the width of one of said fluid applicator bodies.

32. A fluid applicator according to claim 31, having at least one end seal removably and sealingly attachable to close off at least one end portion of said fluid outlet of one of said plurality of adjacent fluid applicator bodies in order to limit application of the fluid to a longitudinally traveling substrate having a width less than the total width of said plurality of said adjacent fluid applicator bodies, said end portion of said one of said fluid applicator bodies including a selectively operable flushing fluid outlet for discharging said fluid from said closed applicator bodies laterally outboard of said fluid outlet end seals.

33. A fluid applicator according to claim 32, including a selectively operable flushing valve in fluid communication with said flushing fluid outlet, and a selectively operable inlet valve in fluid communication with said fluid inlet of said one of said plurality of fluid applicator bodies, said flushing valve and said inlet valve being selectively operable for discharging a preselected quantity of the fluid that is equal to or less than a preselected quantity of the fluid flowing through said fluid inlet and into said fluid chamber of said one of said fluid applicator bodies.

34. A fluid applicator according to claim 33, further including a recirculation system selectively operable for returning said discharged fluid from said flushing fluid outlet to the fluid source.

35. A fluid applicator claim 34, wherein said recirculation system includes a recirculation tank for collecting said discharged fluid from said flushing fluid outlet, said recirculation tank being in fluid communication between said flushing valve and the fluid source.

36. A fluid applicator according to claim 14, wherein the fluid has a viscosity greater than the viscosity of water.

37. A fluid applicator according to claim 14, wherein said fluid applicator includes a plurality of said support members spaced about the periphery of said plate member.

38. A fluid applicator according to claim 14, wherein at least a first portion of said hollow interior fluid chamber is integrally formed as a recess formed in one of a number of body members sealingly secured to each other to form said hollow interior fluid chamber therebetween, at least a portion of said plate member being disposed within said recess.

39. A fluid applicator for applying a fluid from a fluid source across the width of a traveling substrate, comprising a plurality of fluid applicator bodies disposed in an end-to-end adjacent fluid communicating relationship with one another, each of said fluid applicator bodies having a fluid inlet, an elongated fluid outlet positionable in close proximity with the traveling substrate, a hollow interior fluid chamber in fluid communication between said fluid inlet and said fluid outlet, said fluid chamber being defined by chamber walls, a plate member disposed in said fluid chamber in a spaced apart relationship with said chamber walls in order to define a fluid pathway extending in opposite directions from said fluid inlet to said fluid outlet, and an end seal removably and sealing attachable to close off at least an outboard portion of said fluid outlet of an outboard one of said plurality of adjacent fluid applicators in order to accommodate application of the fluid to a traveling substrate having a width less than the total width of said plurality of said adjacent fluid applicator bodies, an outboard end of said outboard one of said fluid applicator bodies including a flushing fluid outlet for discharging a quantity of the fluid from said closed off portion of said outboard fluid outlet, each of said fluid inlets being in fluid communication with a selectively operable inlet valve for admitting a preselected inlet quantity of the fluid into a respective one of said fluid chambers, and said flushing fluid outlet being in fluid communication with a selectively operable flushing valve for discharging a preselected discharge quantity of said fluid from said closed off portion of said outboard portion of said fluid outlet.

40. An apparatus according to claim 39, wherein said flushing fluid outlet is in fluid communication with said fluid source in order to recirculate said discharged quantity of fluid thereto.

41. An apparatus according to claim 40, further including a recirculation tank in fluid communication between said flushing fluid outlet and said fluid source.

42. A fluid applicator for applying a fluid from a fluid source across the lateral width of a longitudinally traveling substrate, said fluid applicator comprising:

a body having a pair of spaced apart body walls;

a fluid inlet formed in and extending through one of said body walls, said fluid inlet being in fluid communication with the fluid source;

an outer body edge interconnecting said spaced apart body walls to define a hollow interior fluid chamber therebetween, said fluid chamber extending in substantially all directions relative to said fluid inlet;

a plate member disposed within said interior fluid chamber and having opposite plate walls spaced from said body walls, said plate member having an outer plate edge spaced from said body edge to form a peripheral passage therebetween;

a support member interconnecting said plate member and said body and holding said plate member in said spaced relationship from said body walls and said body edge; and an elongated fluid outlet formed in and extending through the other of said body walls on an opposite side of said plate member from said fluid inlet, said fluid applicator directing fluid from said fluid inlet divergingly outwardly therefrom, through said annular passage between said body edge and said plate edge, and convergingly inwardly from said body and plate edges to discharge the fluid from said fluid outlet for application to the traveling substrate.

43. A fluid applicator according to claim 42, wherein said body edge and said plate edge are arcuate in shape.

44. A fluid applicator according to claim 43, wherein said body edge and said plate edge are substantially parabolic in shape.

45. A fluid applicator according to claim 42, wherein said fluid applicator has a single fluid applicator body.

46. A fluid applicator according to claim 42, wherein said fluid applicator has a plurality of said fluid applicator bodies.

47. A fluid applicator according to claim 46, wherein each of said fluid applicator bodies has a separate fluid inlet formed therein.

48. A fluid applicator according to claim 47, further including an inlet valve in fluid communication with each of said fluid inlets.

49. A fluid applicator according to claim 48, wherein each of said inlet valves is separately operable continuously between an open position and a closed position.

50. A fluid applicator according to claim 42, wherein at least a first portion of said hollow interior fluid chamber is integrally formed as a recess formed in one of a number of body members sealingly secured to each other to form said hollow interior fluid chamber therebetween, at least a portion of said plate member being disposed within said recess.

* * * * *